US005157890A

United States Patent [19]

Jines

[11] Patent Number: 5,157,890

[45] Date of Patent: Oct. 27, 1992

[54] FLOORING

[75] Inventor: Michael D. Jines, Owatonna, Minn.

[73] Assignee: Wenger Corporation, Owatonna, Minn.

[21] Appl. No.: 652,997

[22] Filed: Feb. 7, 1991

[51] Int. Cl.[5] ..... E04B 5/02

[52] U.S. Cl. ..... 52/584; 52/595; 52/476; 52/589; 52/586; 52/656

[58] Field of Search ..... 52/589, 476, 595, 586, 52/286, 822, 788, 656

[56] References Cited

U.S. PATENT DOCUMENTS

| | | | |
|---|---|---|---|
| 1,913,290 | 6/1933 | Rockwell | 52/595 |
| 2,607,454 | 8/1952 | Brooks | 52/476 |
| 2,924,858 | 2/1960 | Couse et al. | 52/589 |
| 3,685,222 | 8/1972 | Curtess | 52/274 |
| 3,973,368 | 8/1976 | Moeller | 52/476 |
| 4,438,613 | 3/1984 | Hintsa et al. | 52/822 |

FOREIGN PATENT DOCUMENTS

| | | | |
|---|---|---|---|
| 1332297 | 10/1973 | United Kingdom | 52/586 |

*Primary Examiner*—David A. Scherbel
*Assistant Examiner*—Wynn Wood
*Attorney, Agent, or Firm*—Dorsey & Whitney

[57] ABSTRACT

The present invention provides a flooring system that can be quickly, accurately and easily installed in various sorts of buildings, including temporary structures, prefabricated buildings or permanent structures such as factories, homes or offices. The flooring system broadly consists of individual panel assemblies that may be cooperatively interengaged. The periphery of each panel is bound by frame members having two spaced generally parallel flanges and a generally perpendicular web extending therebetween. On one side of the web, between the upper and lower flanges, the frame members include a track for receiving a key block. The key block comprises a generally rectangular base with a key tongue extending therefrom. The base is slidably received in the track of one frame member and the tongue is received in the track of an adjacent frame member. The frame members may be miter cut to a desired length and the corners fastened together by a corner fastener.

7 Claims, 4 Drawing Sheets

Fig. 4
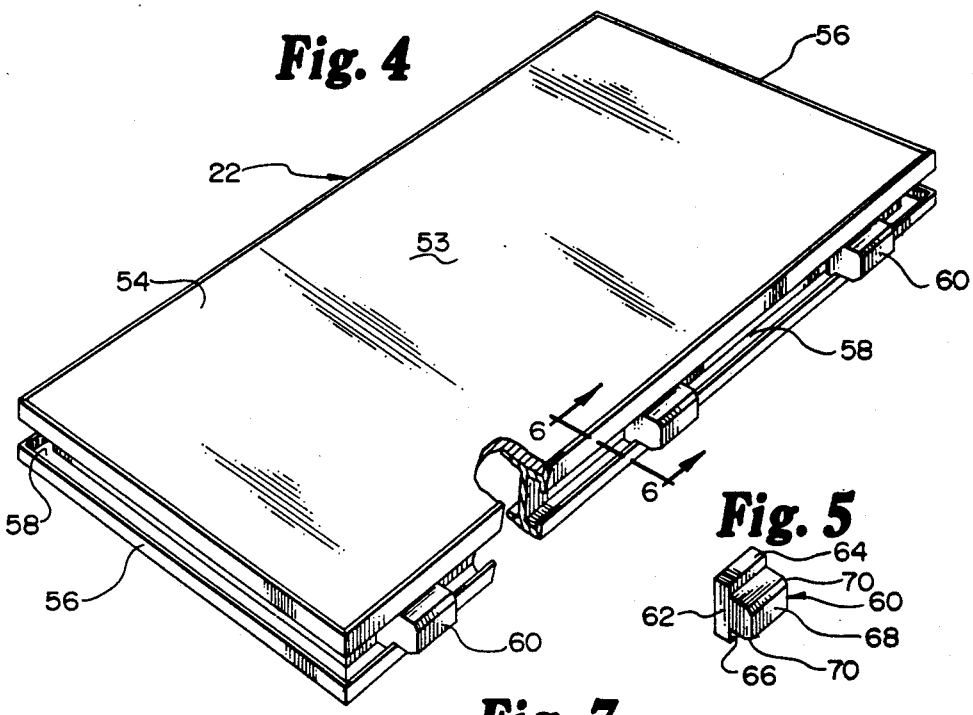
Fig. 5
Fig. 6
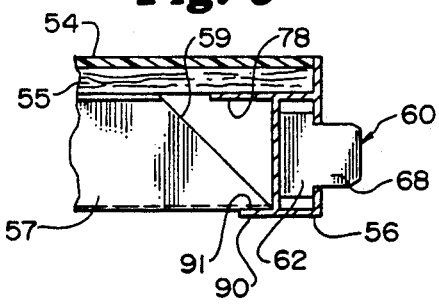
Fig. 7
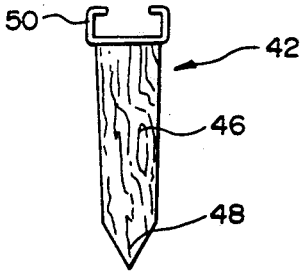
Fig. 8
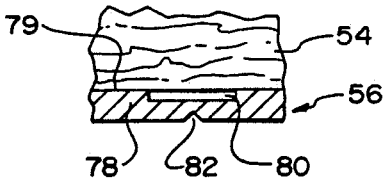
Fig. 9
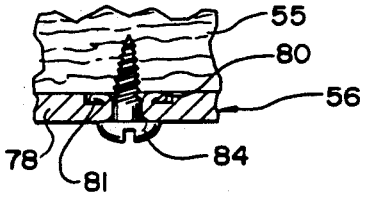

FLOORING

TECHNICAL FIELD

The present invention relates to building construction. In particular, it relates to a flooring system, including floor panel assemblies, wherein individual panels are interengaged to create a floor surface.

BACKGROUND OF THE INVENTION

Pre-fabricated floors and subfloors for permanent use in various kinds of buildings, including dwellings, industrial and office buildings, agricultural structures and others, are known. Generally, such systems comprise a supporting framework and an overlying floor material such as a plurality of panels or sheet material. Individual panels or floor material may be attached to the framework by various means.

Portable flooring such as portable stage flooring or false floors for providing space for conduits in buildings are known as well. This type of floor generally includes a framework for supporting moveable individual panels. The panels may have an edge adapted to be fitted with other abutting panel edges or with the supporting framework. Such floor systems may find particular applicability in temporary buildings such as on-site construction offices or other temporary structures. Additionally, such systems may be used as temporary floors in buildings under construction.

There are some problems which have not been completely addressed by existing flooring systems. One such problem is that it has been difficult to ensure that the upper surface of the plurality of panels comprising the floor or subfloor surface remains in horizontal alignment. Another problem is that it is difficult to maintain standardization of the various components comprising a floor system. For example, typical milled lumber has nominal dimensions only and there is always some variation. Builders frequently have to resort to shims or other devices to level the floor supports relative to one another or to level the floor panels with respect to one another and with respect to the supporting framework.

Another problem is that when a flooring surface is provided by a plurality of adjacent panels with abutting edges, the individual panels may deflect or be depressed relative to one another as weight is put on them. Again, traditionally, shims or fasteners have been used to control the deflection, but shims frequently require much time or effort to install, expending expensive manhours and increasing construction costs. A related problem is that with the passage of time, the shims may work free, generating expensive remedial work.

Clearly, there remains the need for a safe, durable and strong flooring system that substantially reduces cost of flooring, minimizes deflection in the floor system, yet is simple and cost effective to manufacture and install.

SUMMARY OF THE INVENTION

The present invention provides a flooring system that can be quickly, accurately and easily installed in various sorts of buildings, including temporary structures, prefabricated building or permanent structures such as factories, homes or offices. The flooring system broadly consists of individual panel assemblies that may be cooperatively interengaged. The periphery of each panel is bound by extruded frame members having two spaced generally parallel flanges and a generally perpendicular web extending therebetween. On one side of the web, between the upper and lower flanges, the frame members include track for receiving a key block. The key block comprises a generally rectangular base with a key tongue extending therefrom. The base is slidably received in the track of one frame member and the tongue is received in the track of an adjacent frame member. The fame members may be miter cut to a desired length and the corners fastened together by a corner fastener.

A feature of the present invention is that the frame members may be fastened together in any desired configuration for forming a plurality of interlocking complimentary floor panels. The panels are lightweight and convenient to store, transport and install.

Another feature of the present invention is interengaging of individual panels, whereby the surface of adjacent panels can be aligned and kept in alignment even when substantial weight or force is exerted downwardly on one panel.

It is an object of he present invention to provide a flooring system comprises of a plurality of adjacent complimentary, interengaged, framed panels that minimizes the deflection of adjacent panels, providing a more secure and aesthetically pleasing floor.

Another object of the present invention is to provide a durable flooring system that is inexpensive and cost effective to manufacture and requires no special tools to install. Additionally, the floor system may be installed temporarily in one location, yet easily may be taken apart, moved and reinstalled at another location.

BRIEF DESCRIPTION OF THE DRAWINGS

FIG. 4 is a perspective view depicting a single floor panel with portions broken away.

FIG. 5 is a perspective view depicting a joining element for the floor system of the present invention.

FIG. 6 is a fragmentary sectional view taken along line 6—6 in FIG. 4.

FIG. 7 is a side elevational view depicting a support stake with which the present invention might be used.

FIG. 8 is an enlarged fragmentary sectional view depicting a portion of one of the extruded frame members of the present invention.

FIG. 9 is a view similar to that of FIG. 8, depicting a fastener secured in a frame member.

DESCRIPTION OF THE PREFERRED EMBODIMENT

Figure 3:
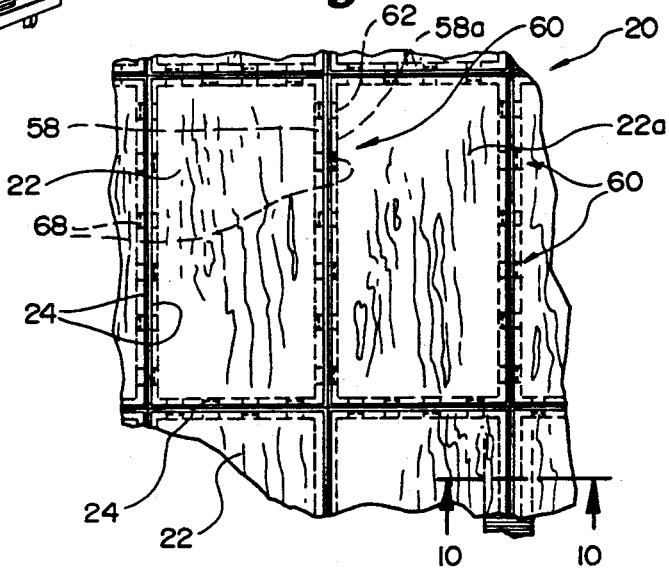
FIG. 3 is a top plan view depicting the interengagement of individual floor panels into the flooring system of the present invention.

Referring to FIG. 3, the flooring system 20 of the present invention is depicted. The system 20 is made up of a plurality of individual floor panels 22 each having a frame 24.

Figure 1:
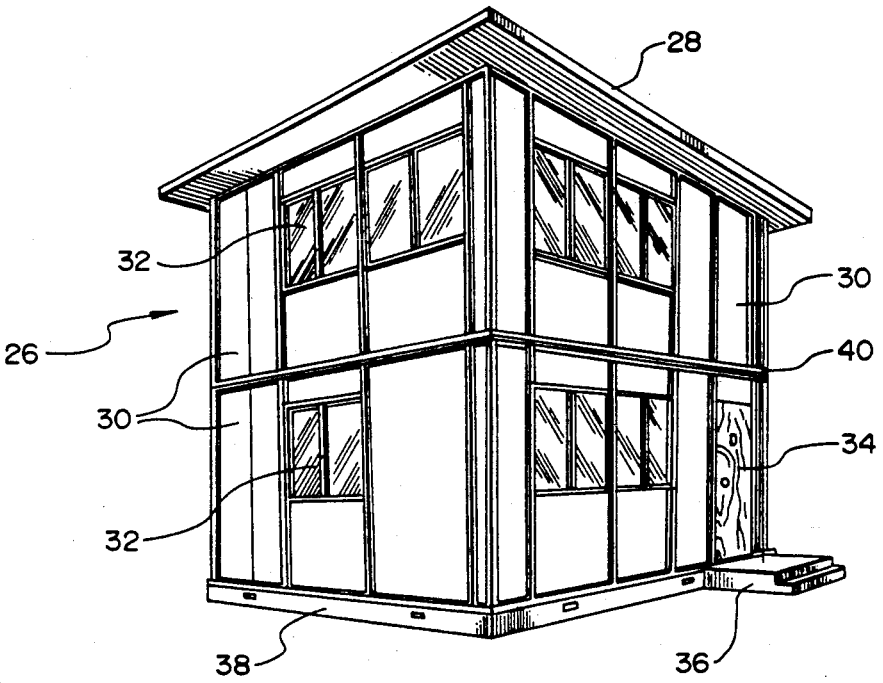
FIG. 1 is a perspective view depicting a pre-fabricated dwelling of a type in which the present invention may be used.

A pre-fabricated building 26 of the type in which the flooring system 20 of the present invention might be used is depicted in FIG. 1. The building includes a roof 28, wall panels 30 and windows 32. An access door 34 and an entry stoop 36 are depicted as well. The floor system 20 of the present invention may be supported within the building 26 by the foundation 38 or by the second floor frame 40. It is within the scope of the present invention that the flooring system 20 of the present invention might be used in buildings having more than two stories; the building 26 depicted in FIG. 1 is representational only.

Although the details are not depicted, the foundation 38 of the building 26, as well as the second floor frame 40, may be typical sill and joist type foundations or frames upon which the floor system 20 of the present invention may rest.

Figure 2:
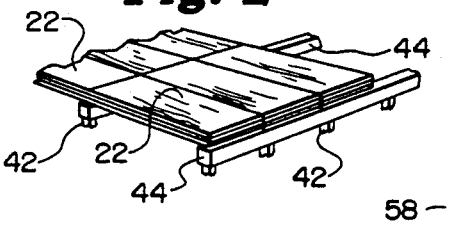
FIG. 2 is a perspective view depicting the flooring system of the present invention and a typical support structure therefore.

Alternatively, the floor system 20 may be used with a supporting frame or foundation of the type depicted in FIG. 2. A plurality of stakes 42 support a support member 44. Individual floor panels 22 comprising the flooring system 20 rest on the support member 44. A stake is depicted in FIG. 7 and includes a shank 46 having a point 48 at one end and a support channel 50 at the opposite end. A wooden stake 42 is depicted, but other suitable materials, as well as lengths, may be used. Likewise, although a "block-type" support member 44 is depicted in FIG. 2, an I-beam support member 45 (depicted in FIG. 10) may be used with the present invention.

FIG. 4 depicts an individual floor panel assembly 22. The floor panel 22 has central flooring material 54 with a central area 53. The perimeter or edge of the flooring material 54 is bound and enclosed by extruded frame members 56. The frame members 56 broadly are modified I-beams including a generally central key track 58 on the outer side thereof. The key track 58 extends continuously for the length of a frame member 56 and receives a selected number of key blocks 60.

Each key block 60, depicted in FIGS. 5 and 6 comprises a general rectangular key block base 62 having an upper key bar 64 and a lower key bar 66. Extending from one side of the base 62, each key block 60 includes a rectangular tongue 68. The tongue has upper and lower chamfered edges 70.

FIGS. 8 and 9 depict how the finish floor material 54 or subfloor 55 may be secured to and cladded by the extruded frame members 56. Specifically, the extruded frame member 56 includes a fastening flange 78 having an upper surface 79 with a flashing channel 80 and an opposite bottom surface having a fastener point groove 82. FIG. 9 depicts the fastening flange 78 with a fastener 84 driven therethrough into a wooden subfloor member 55. A flashing burr 81 is depicted in the flashing channel 80, provided so that the burr 81 does not displace or raise the subfloor 55 away from the fame member 56 and fastening flange 78. The groove 82 is continuous along the length of the frame member 56, as is the flashing channel 80.

Figure 10:
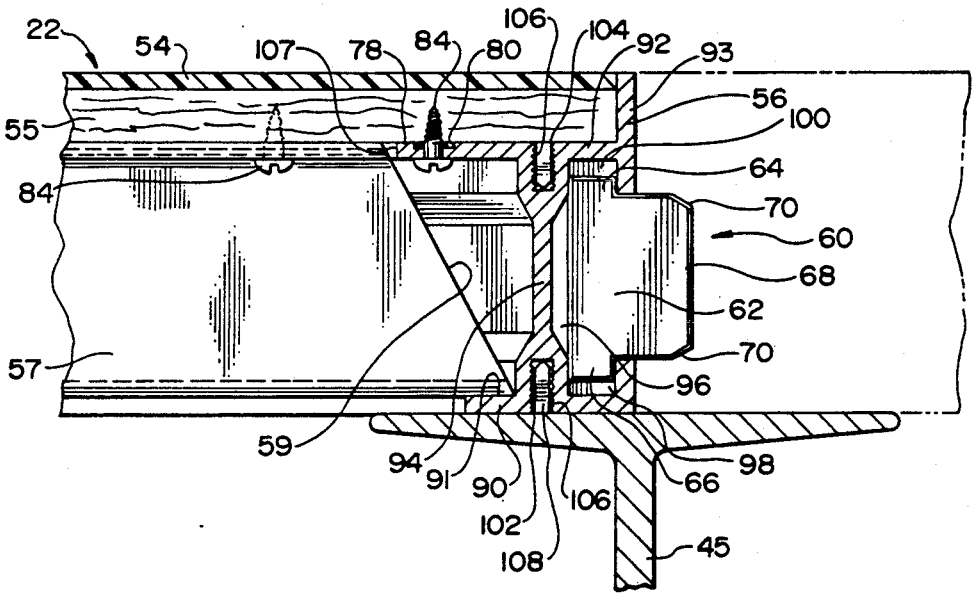
FIG. 10 is a fragmentary sectional view taken along line 10—10 in FIG. 3.

Additional detail regarding the extruded frame member 56 is depicted in FIG. 10. The frame member 56 includes a lower flange 90 and an upper flange 92. The fastening flange 78 is basically an extension of the upper flange 92. Opposite the fastening flange 78 and adjacent its outermost edge, the upper flange 92 has an upstanding lip 93. A central, generally upstanding web 94 extends between and is generally perpendicular to the upper and lower flanges 92, 90 respectively. Between the upper and lower flanges 92, 90 on the outside of the web 94 and the frame member 56, the frame member 56 has a key track 96. The key track 96 includes a lower channel 98 and an upper channel 100. The upper and lower channels 98, 100 are dimensioned to receive closely the upper and lower key bars 64,66 of the key block 60.

The frame member 56 include upper and lower corner fastening slots 102, 104, respectively. The slots 102, 104 extended into the member 56, are collinear with the web 94 and have serrated or ridged inner surfaces 106. The slots 102, 104 are generally centrally located with respect to the upper and lower flanges 90,92 and extend through the thickness of the flanges 90,92 into the web 94. It is within the scope of the present invention that upper and lower slots 102, 104 be provided as depicted or, alternatively, only an upper or only a lower slot may be used.

The upper flange 92 has a relatively larger outer surface area than the lower flange 90, extending inwardly toward the center 53 of the floor panel assembly 22 farther than the lower flange 90. Adjacent the innermost edge 107 of the upper flange 92, a screw fastener 84 is received in the point groove 82 and flashing channel 80 (as depicted in FIGS. 8 and 9). A staple-like corner fastener 108 is in the slots 102, 104.

Figure 11:
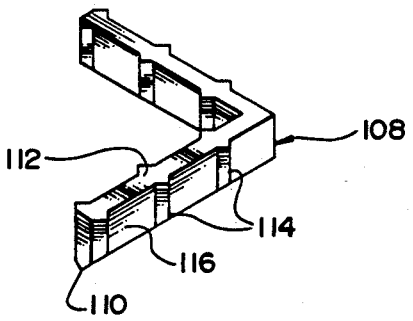
FIG. 11 is a perspective view depicting a corner fastener for use with the present invention.

FIG. 11 is a perspective view depicting the corner fastener 108. The fastener 108 has a generally L-shaped body with a base knife edge 110 and a flat upper surface 112. Vertical knife ribs 114 are provided on the sides 116 of the fasteners 108. Horizontal knife ribs (not depicted) also might be used.

Figure 13:
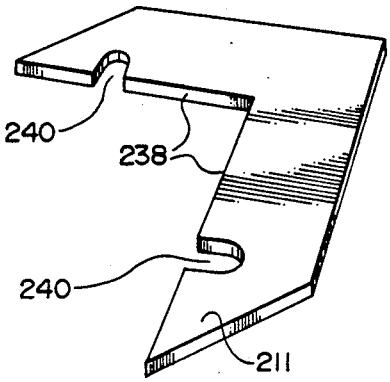
FIG. 13 is a perspective view depicting the second embodiment of the corner fastener.
Figure 12:
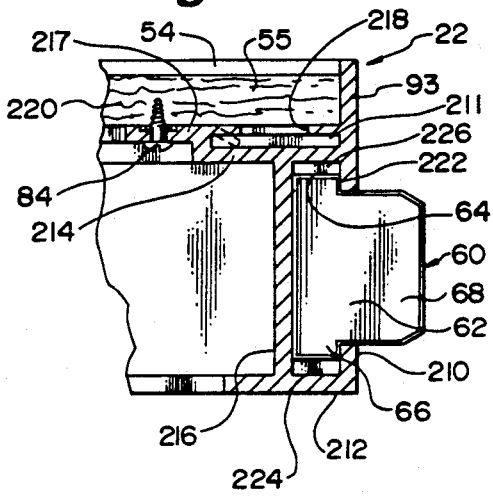
FIG. 12 is a fragmentary sectional view similar to that of FIG. 10 depicting a second embodiment of the corner fastener for use with the present invention.
Figure 14:
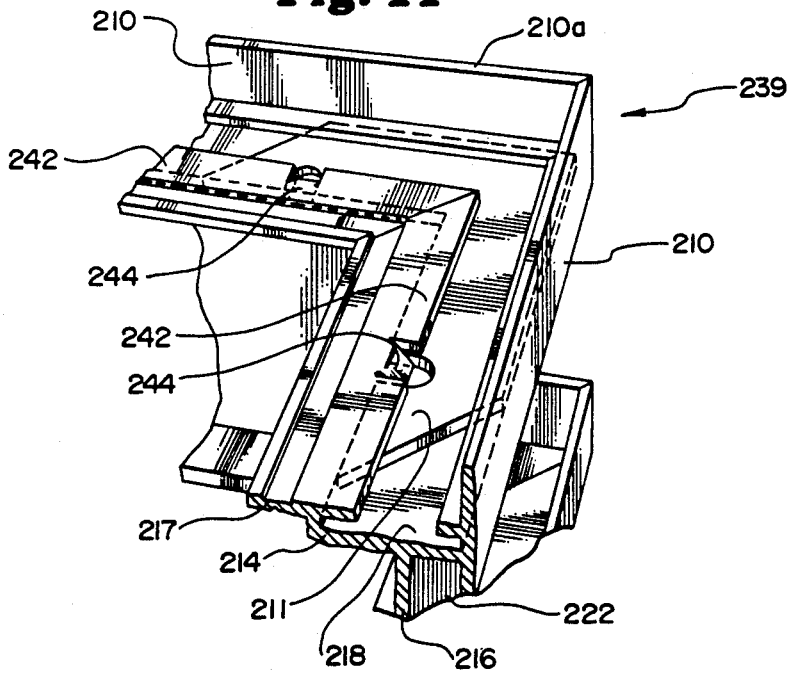
FIG. 14 is a fragmentary perspective view depicting the second embodiment of the corner fastener installed at a corner.

FIGS. 12–14 depict a second embodiment of the present invention and, in particular, a second embodiment of an extruded frame member 210 and a fastener 211. Like the first embodiment frame member 56, the frame member 210 of the second embodiment includes upper and lower flanges 212,214 and a generally central web 216 extending perpendicularly therebetween. The upper surface of the upper flange 212 includes a fastener flange 217 having a fastener receiving slot 218. The outermost side of the frame member 210 relative to the general center of the flooring material 220 includes a key track 222, having a lower channel 224 and an upper channel 226.

The key block 60 depicted in FIG. 12 is substantially similar to the key block 60 depicted in FIG. 10 and is numbered commonly with the key block 60 of FIG. 10.

FIG. 13 shows the corner fastener 211 used to secure the frame members 210 together at the corners of a floor panel 22. Specifically, the second embodiment of the corner fastener 211 is a generally flat side fastener in an angle cut L-shape. The facing sides 238 of the L-shaped body of the second fastener 211 include tab receiving notches 240.

FIG. 14 depicts additional detail about how the second embodiment corner fastener 211 is received and fixed in a channel 218 in the frame member 210. A mitered corner 239 is depicted, a 45° cut having been made in two elongated sections of frame member material, creating frame members 210 and 210*a*. The upper and inside ledge 242 of the channel 218 includes a plurality of deflectable tabs 244. The tabs 244 may be located at regular intervals along the ledge 242 or may be provided at intermittent intervals along the ledge 242.

In use, the floor system 20 of the present invention may be installed on a block type member 44, a foundation 38 with a sill and joist arrangement, or an I-beam type support 45.

First, the individual floor panels 22 are manufactured and assembled. The size and perimeter configuration of the floor panels 22 may be selected and the required lengths of the extruded frame members 56 may be made by making miter cuts at 45° for rectangular or square panels. Appropriate joining cuts may be made for other geometric shapes for the panel 22.

A selected number of key blocks 60 may be slidably installed in the block receiving tracks 58 prior to connecting the frame members 56 at the corners of a panel 22. The key blocks 60 are freely slidable along the length of the track 58, whereby their positions relative to other adjacent floor panels 22 may be varied. Also, interference with electrical or other conduits in the building structure may be avoided by sliding the blocks 60 to an appropriate location. Generally, a block 60 may be placed approximately every two feet around the perimeter of a floor panel 22.

Next, either the first embodiment corner fastener 108 or the second embodiment corner fastener 211 is selected, depending upon which embodiment of the frame members 56 or 210 is selected. The first corner fastener 108, depicted in FIG. 10, is a friction-type fastener and is designed to be interference fit in slots 102, 104. The framing members 56 are aligned and the corner fastener 108 may be driven or hammered into tight frictional engagement at the intersection of the frame members 56, thereby holding the frame members 56 in the desired geometrical arrangement.

Subfloor panels 55 may be laid in place on the top of the frame members 56 within the confines of the lip 93. Screw fasteners 84 may be driven into the subfloor panel 55 through the upper flange 92 or 217 (in the second embodiment). Finally, a finish floor layer 54 may be installed over the subfloor panel 55.

It should be appreciated that a selected number of supplemental structural beams 57 (depicted in FIG. 6 and 10) may be used to span the distance between the frame members 56 either longitudinally or transversely. The structural beams 57 depicted in FIGS. 6 and 10 are typical I-shaped beams having angle-cut ends 59. The ends 59 enable the beams 57 to be supported adequately on the upper surface of the inside lip 91 of the lower flange 90, yet be rotated into place without interference from the frame members 56. Additional screw fasteners 84 may be used along the length of the beams 57 to secure the subfloor panel 55 to beams 57 after they have been rotated into place between the panel 55 and the lip 91.

FIG. 3 depicts a portion of the floor system 20 of the present invention as it might be installed in the building 26. Specifically, a number of individual floor panels 22 (as depicted in FIG. 4) have been laid tightly adjacent to one another. The tongue 68 of the key block 60 in one key track 58 of one floor panel 22 extends sufficiently far outwardly therefrom to enter the key track **58*a* of an adjacent floor panel assembly 22*a*. It should be appreciated that this engagement, carried across the extent of the floor system 20, aligns the adjacent panels and provides a substantial degree of structural integrity, preventing the deflection of adjacent panels 22,22*a*** as weight is applied unequally to the upper surface thereof.

The floor system 20 of the present invention is lightweight, durable and can be assembled without requiring specially adapted tools. The material of choice for the extruded frame members 56 is aluminum; however, any suitable lightweight metallic or plastic material may be used a long as sufficient rigidity and tolerances are obtained. Likewise, the key blocks may be made from many suitable materials; nylon is one such material. The subfloor and finish floor material also may be selected from a variety of appropriate material.

What is claimed and desired to be protected by Letters Patent is:

1. Panel assembly for a flooring system comprising:

a plurality of panels, each panel having a central region and a perimeter;

framing means for cladding said perimeter, said framing means fixedly attached to said panel, substantially rigid and comprising upper and lower parallel flanges with a web extending generally perpendicularly therebetween, said web having an inner face and an outer face, said outer face comprising an elongated tack; and locking means slidably received and permanently secured in said framing means for integrating each said panel into said flooring system, said locking means comprising a base with upper and lower slide means receivable within said track and a tongue means extending outwardly from said base for being received in the frame means of an adjacent panel assembly.

2. The panel assembly according to claim 1, wherein said track extends substantially completely between said upper and lower flanges, the areas of said track adjacent said flanges comprising upper and lower channels complimentary to said upper and lower slide means whereby said slide means fits closely in said channels, said track further including an opening between said upper and lower channels, said opening for receiving said tongue means.

3. The panel assembly according to claim 2, wherein said upper flange has a top, outer surface having an upstanding lip adjacent the edge thereof.

4. The panel assembly according to claim 2, wherein said upper flange guide means for aligning fastening means for fastening said panel to said framing means.

5. A floor system comprising:

a plurality of substantially adjacent panels, each said panel including a central region and a cladding frame, said frame directly attached to said panel and extending around the edge of said panel and comprising upper and lower flanges parallel to said panel and a web extending generally perpendicularly between said flanges, said web having a central region facing side and an opposite side, said opposite side comprising an aligning means receiving track;

a support means contacting said cladding frame, said support means for supporting said floor system; and aligning means for aligning said adjacent panels, said aligning means including a key having a base slidably received and permanently secured in said aligning means receiving track of a first said panel and a tongue receivable in the adjacent said aligning means receiving tack of a second said panel.

6. The panel assembly according to claim 1, wherein said upper and lower flanges include slots for receiving a corner fastener at each corner of said framing means, said corner fastener having an L-shaped body with knife ribs for contacting the sides of said slot.

7. The panel assembly according to claim 1, wherein said framing means includes a generally flat channel for receiving a corner fastener at each corner of said framing means, said corner fastener having a generally flat L-shaped body with tab receiving notches, said framing means further including tabs that can be deflected into said tab receiving notches.

* * * * *

UNITED STATES PATENT AND TRADEMARK OFFICE

CERTIFICATE OF CORRECTION

PATENT NO. : 5,157,890

DATED : October 27, 1992

INVENTOR(S) : Michael D. Jines

It is certified that error appears in the above-identified patent and that said Letters Patent is hereby corrected as shown below:

Column 2, line 21, delete the word "he" and substitute therefor --the--.

Column 4, line 15, delete the word "include" and substitute therefor --includes--.

Column 5, line 45, delete the word "FIG." and substitute therefor --FIGS.--.

Column 6, line 25, delete the word "tack" and substitute therefor --track--.

Column 6, line 68, delete the word "tack" and substitute therefor --track--.

Signed and Sealed this

Second Day of November, 1993

*Attest:*

Bruce Lehman

BRUCE LEHMAN

*Attesting Officer*

*Commissioner of Patents and Trademarks*